United States Patent [19]

Choinski

[11] 4,154,879

[45] May 15, 1979

[54] METHOD AND APPARATUS FOR COATING WEBS WITH A PLURALITY OF LIQUID LAYERS

[75] Inventor: Edward J. Choinski, Wayland, Mass.

[73] Assignee: Polaroid Corporation, Cambridge, Mass.

[21] Appl. No.: 762,949

[22] Filed: Jan. 27, 1977

[51] Int. Cl.[2] ..... B05D 1/34; B05C 3/02

[52] U.S. Cl. ..... 427/402; 118/50; 118/411; 118/412; 427/434 A

[58] Field of Search ..... 118/411, 412, 50, 410; 427/434 A, 434 R, 402

[56] References Cited

U.S. PATENT DOCUMENTS

| | | | |
|---|---|---|---|
| 2,761,417 | 9/1956 | Russell et al. | 118/412 X |
| 3,928,679 | 12/1975 | Jackson et al. | 118/411 X |

FOREIGN PATENT DOCUMENTS

| | | | |
|---|---|---|---|
| 1029017 | 1966 | United Kingdom | 118/411 |

*Primary Examiner*—Evan K. Lawrence

*Attorney, Agent, or Firm*—John W. Ericson

[57] ABSTRACT

Method and apparatus for coating a moving web with a multilayer liquid composition. A pool of the multilayer liquid composition is formed by flowing liquids along spaced paths through discharge slots exiting into a cavity of a liquid feeding apparatus, the cavity being located adjacent to and spaced apart from the moving web. The discharge slots are spaced progressively farther from the web and the liquid flow paths are aligned in directions that do not intersect the web so that each path is accessible to a cleaning probe inserted through the path slot. The multilayer liquid composition is formed into a bead which extends from the pool into contact with the moving web, and the moving web entrains the multilayer composition from the bead.

12 Claims, 3 Drawing Figures

METHOD AND APPARATUS FOR COATING WEBS WITH A PLURALITY OF LIQUID LAYERS

BACKGROUND OF THE INVENTION

This invention relates to a method and apparatus for coating a moving web with a plurality of coatings and more particularly to a method and apparatus for coating a moving web with a multilayer liquid composition which is subsequently set or gelled on the web.

Presently, there is available coating apparatus for applying a plurality of superimposed layers to a moving web. Typical apparatus utilizes a plurality of inclined slide surfaces separated by exit slots through each of which is metered a coating solution onto an adjacent inclined surface. The coating solutions flow by gravity over the inclined surfaces and those metered through upstream slots flow over coating solutions metered through downstream slots and form a multilayered stream formed of the individual coating solutions that cascades over the downstream inclined surfaces. As the coating solutions flow under gravity over the inclined surfaces, each layer becomes smooth and is of uniform thickness. At the last inclined surface or slide, the multilayered stream is stratified in a configuration which constitutes the desired multilayered coating to be contacted with the moving web. The end of the last slide is spaced apart from the moving web so that the multilayered stream exiting the last slide toward the web forms a bead or bridge between the last slide and the moving web. A pressure differential generally is effected across the bead by applying a vacuum to the bottom surface of the bead immediately adjacent the top surface of the web to stabilize the bead against excessive vibration and rupture. As the web contacts the bead, it entrains the multilayered liquid, thereby becoming coated. Typical examples of the apparatus described above are set forth in U.S. Pat. Nos. 2,761,419; 3,220,877; 3,928,678 and 3,928,679.

The coating apparatus described is useful, for example, to form webs coated with superimposed layers of aqueous photographic compositions including light sensitive materials, chemical sensitizers, antifoggants, developing agents and the like. These compositions are mixed with synthetic or naturally occurring colloids such as gelatin, polyvinyl compounds, or the like, which form non-flowing set layers containing the photographic compositions when the colloid is dried on the web. Unfortunately, oftentimes, chemical or physical reactions occur between adjacent layers to form an intermediate thin third layer as the liquids cascade down the slide apparatus. As the multilayer composition is entrained, the third layer, since it is generally non-uniform, may cause undesirable discontinuities in the adjacent layers. In addition, when there is a wide difference in viscosity between adjacent layers, a hydrodynamic standing wave can form since the low viscosity layers accelerate faster than the higher viscosity layers. Such a standing wave causes non-uniform coatings on the moving web which results in unacceptable coated products, particularly photographic film products.

U.S. Pat. No. 2,932,855 discloses a method for forming a coated sheet by extruding a high viscosity, self-supporting, liquid film composition through a slot and into a bead or beads of low viscosity liquid which are extruded through slots adjacent the slot for the high viscosity liquid. The low viscosity liquids remain in contact with the high viscosity film by surface tension forces. The film coated with low viscosity liquid is entrained onto the surface of a moving drum or onto a web on the moving drum wherein it is dried. The disclosed method is undesirably limited since it requires the use of a self-supporting high viscosity film which cannot be used in a number of applications such as in photographic film. U.S. Pat. No. 3,526,528 discloses a coating apparatus for applying a plurality of liquid layers on a moving web. The liquid layers are extruded individually through slots located on a common feeding head and are coated directly and sequentially onto the moving web. The feeding head must be positioned quite close to the moving web, e.g., 0.2–0.5 mm since the edges of the slots function as doctor blades to regulate the thickness of each liquid layer. Because of this approach, the length of the bead formed between the applicator lip and the web is considerably long, causing particulates on the web to get trapped in the bead and cause streaking. When this occurs or whenever a slot becomes partially blocked with foreign solid matter, the coating procedure must be stopped to remove the feeding head away from the moving web to permit access to the blocked slot.

It would be desirable to provide a coating apparatus and method which assures forming uniform layers within a multilayer liquid composition to be coated on a moving web. In addition, it would be desirable to provide a coating apparatus and method which minimizes the time adjacent liquid layers are in contact in order to minimize reaction between adjacent layers.

SUMMARY OF THE INVENTION

In accordance with this invention, a coating method and apparatus are provided wherein a plurality of liquid compositions are metered under pressure each through one of a plurality of spaced paths terminating in discharge slots exiting into a cavity to form a pool of a multilayer liquid. The cavity is located adjacent the moving web and a bead of the multilayer liquid extends from the pool to the moving web which entrains the multilayer liquid from the bead. The velocity of each layer in the pool is less that its exit velocity from the slot so that each layer becomes thicker in the pool and subsequently becomes thinner as the liquid is drawn into the bead and entrained by the moving web. The slots are spaced progressively farther from the moving web and the liquid flow paths are aligned in directions that do not intersect the web so that they are accessible for cleaning through the slots without removing the cavity from proximity with the moving web. Thus, the flow paths can be cleaned when obstructed by inserting a cleaning probe into the slot and without interrupting the coating process. The length of the bead is also minimized to allow particulates on the web to punch through the bead and not hang up on the lip causing continuous streaks. In addition, since the liquid layers are mutually contacted for a much shorter period as compared to cascade coating apparatus, reaction between contacting layers is minimized, thereby improving coating homogeneity and consistency.

DESCRIPTION OF THE SPECIFIC EMBODIMENTS

Figure 1:
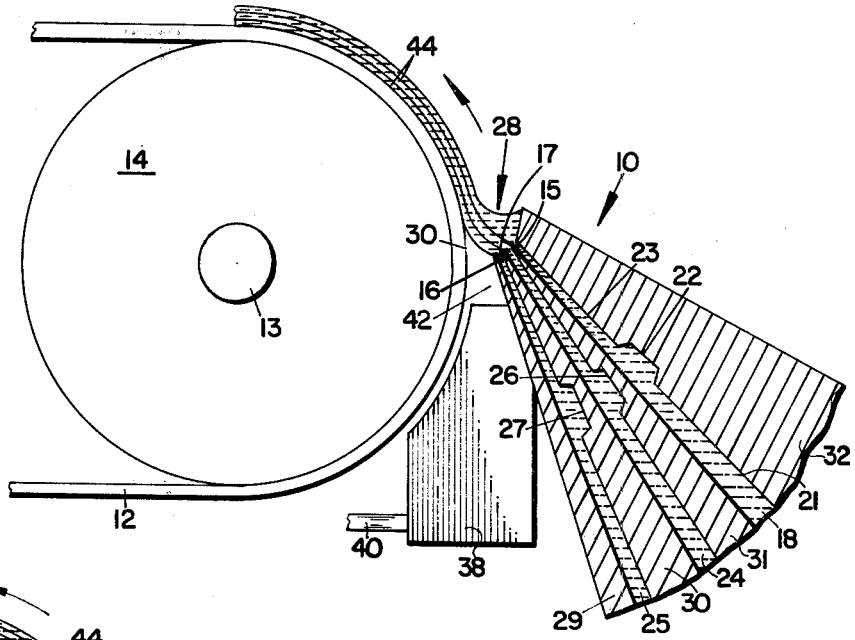
FIG. 1 is a cross-sectional side view of the apparatus of this invention.

Referring to FIG. 1, the coating apparatus 10 is positioned adjacent a web 12 supported by a driven roller 14. The coating apparatus 10 includes a plurality of slots 15, 16 and 17. The coating apparatus 10 is shown in operation for applying a three-layered liquid coating for illustrative purposes. It is to be understood that the liquid can comprise one or more layers if desired. Liquid composition 18 is extruded through slot 15 by a conventional metering pump (not shown) which pumps liquid 18 through channel 21, reservoir 22, channel 23 and through slot 15. Liquid composition 24 also is extruded through slot 16 and liquid composition 25 is extruded through slot 17 also by conventional metering pumps (not shown) which pump liquid into reservoir 26 and reservoir 27 respectively. The width of the slots 15, 16 and 17 is generally coextensive with the width of the web 12. The web 12 is formed of any suitable flexible material such as paper, plastic or metal and may be coated prior to being coated in accordance with this invention. The liquid compositions 18, 24 and 25 exit the respective slots 15, 16 and 17 into a pool 28 which is supported by the liquid exiting the slots 15, 16 and 17 under pressure and by the coating head sections 29, 30, 31 and 32.

A three-layered liquid bead 30 is formed between the head section 29 and the web 12 and the bead is stabilized by a vacuum generated by vacuum chamber 38 which is connected to a vacuum pump (not shown) by conduit 40 to exhaust air from chamber 42. As the web 12 advances the roller 14 past bead 30, it entrains the three-layered liquid to form a coated layer 44 of the three liquids on web 12. The layer 44 is dried in any conventional manner downstream of the roller 14.

The flow of liquid to be coated on the moving web 12 will be described with reference to FIG. 2 wherein like reference numbers represent like coating apparatus elements of FIG. 1. The liquid compositions 18, 24 and 25 are extruded through slots 15, 16 and 17 respectively under pressure and into the multilayer pool 28. The velocity of each liquid layer in the pool 28 is less than their exit velocity from their respective slots and the layers increase in thickness in the pool until they are entrained by the moving web 12. The liquid layers are reduced in thickness as they are drawn into the bead 30 from the pool 28 and from the bead 30 onto the surface of web 12. In use, the coating apparatus is positioned so that the slot 17 generally is between about 45° below the horizontal diameter of roller 14 and 45° above the horizontal diameter of roller 14 in order to obtain optimum uniform coating. The gap between the top of coating head section 29 and the web 12 generally is between about 0.005 and 0.060 inches.

Figure 2:
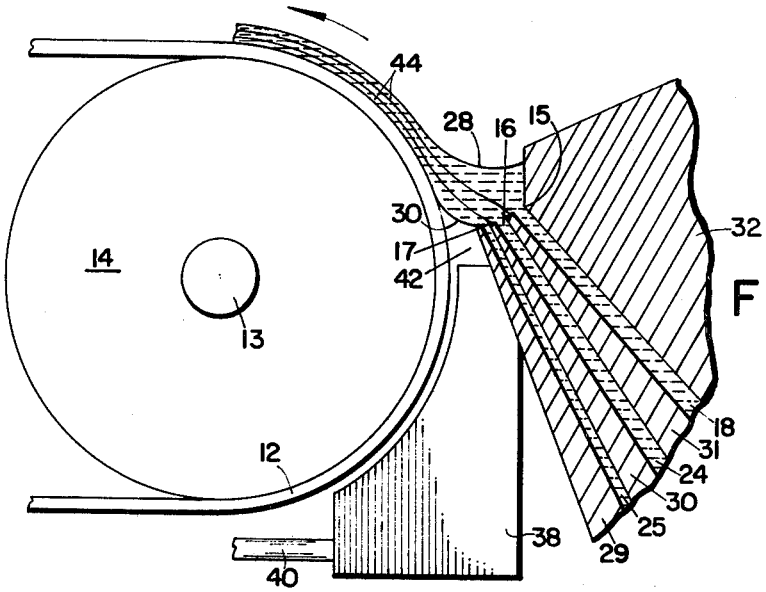
FIG. 2 is a close-up view of the apparatus of FIG. 1.

The coating apparatus of FIGS. 1 and 2 provide substantial advantages over the coating apparatus of the prior art in that the contact time between adjacent layers is minimized and the reaction between layers, if any, is correspondingly minimized. Furthermore, since the slots 15, 16 and 17 are not positioned to face the moving web 12, they can be easily shimmed should slot blockage occur without interrupting the coating process.

Figure 3:
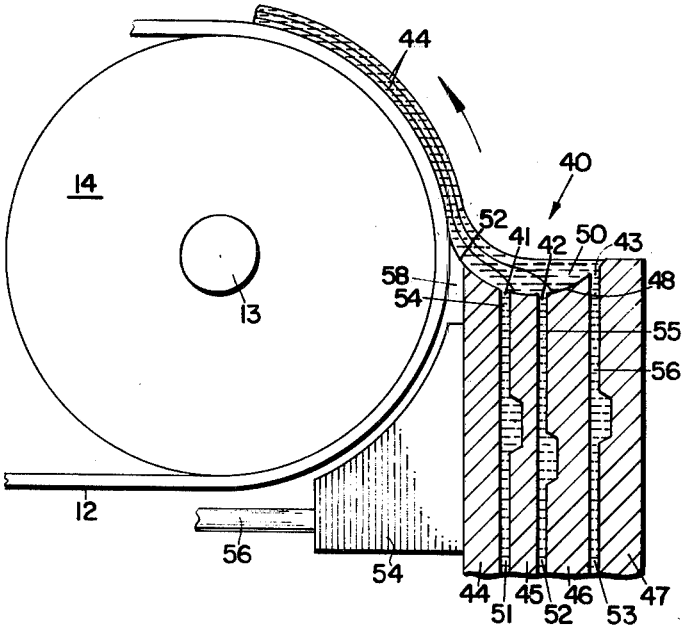
FIG. 3 is a cross-sectional side view of an alternative construction of this invention.

An alternative embodiment of this invention is shown in FIG. 3. The coating apparatus 40 is positioned adjacent a web 12 supported on a driven roller 14. The coating apparatus 40 includes slots 41, 42 and 43 and coating bead sections 44, 45, 46 and 47. The top surfaces of sections 44, 45, 46 and 47 are formed of smooth concave surfaces so that in combination, they form a reservoir 48 to support a multilayer liquid pool 50. The pool 50 is formed by metering liquids 51, 52 and 53 respectively through channels 54, 55 and 56 by utilizing conventional metering means (not shown). In the manner discussed above with reference to FIG. 2, the velocity of the liquid layers in pool 50 is less than the exit velocity from the slots 41, 42 and 43 so that each layer becomes thicker during its residence time in pool 50 until entrained by moving web 12. A multilayer liquid bead 52 is formed between the bead section 44 and the web 12. The bead 52 is stabilized by a vacuum generated by vacuum chamber 54 which is connected to a vacuum pump (not shown) by conduit 56 to exhaust air from chamber 58. As the web 12 advances with the roller 14 past bead 52, it entrains the multilayer liquid to form a coated layer 44 on the web 12. The apparatus of FIG. 3 provides substantially the same advantages as the apparatus of FIGS. 1 and 2. Since the pool 50 is somewhat larger than the pool 28 of FIGS. 1 and 2, the liquid layers are in contact for a slightly longer time than the liquid layers in the apparatus of FIGS. 1 and 2 for a given coating speed. However, this contact time is substantially less than the contact time encountered with conventional slide coaters. In addition, the apparatus of FIG. 3 provides a self-healing effect on a disrupted liquid layer which is caused by partial blockage of one of the slots 41, 42 or 43 with foreign solid matter. Should a slot become partially blocked with a solid particle, an area adjacent the particle will be deprived on the liquid extruded from the slot. That area will be filled in by the liquid located above the disrupted layer. However, as the layers reach the bottom of the concave surface 48, their flow rates are reduced and the disrupted layer will become thicker and will fill in the disrupted area and the upper liquid layer in the disrupted area will be forced upwardly into its own liquid layer. By providing the concave surface shown, undesirable streaking previously encountered when the discharge slots are blocked, is eliminated. Accordingly, the apparatus of FIG. 3 provides substantial advantages over the coating procedures of the prior art.

It is to be understood that this invention is not limited to the embodiments specifically described, but includes modifications which will be evident to the persons skilled in the art.

What is claimed is:

1. The method for coating a moving web with a liquid composition comprising a plurality of liquid layers wherein layers within said composition are separate and distinct which comprises:

a. flowing a plurality of liquids along spaced paths through discharge slots exiting into a cavity adjacent the moving web to form a pool in said cavity comprising a plurality of separate and distinct contiguous superposed liquid layers of reduced velocities and increased thicknesses, said slots being spaced progressively farther from said web and said paths being aligned in directions that do not intersect the web so that each path is accessible by a cleaning probe inserted through the path slot with the moving web in place; and b. flowing the liquids in said pool directly across a gap between said pool and said moving web to form a bead in which said layers are thinned and coat said moving web.

2. The method of claim 1 wherein said liquids are directed to said pool along generally mutually convergent paths.

3. The method of claim 1 wherein said liquids are directed to said pool along generally mutually parallel paths.

4. The method of claim 1 including the step of establishing a pressure differential across the liquid composition in said gap wherein the lowermost layer is exposed to a lower pressure.

5. The method of claim 2 including the step of establishing a pressure differential across the liquid composition in said gap wherein the lowermost layer is exposed to a lower pressure.

6. The method of claim 3 including the step of establishing a pressure differential across the liquid composition in said gap wherein the lowermost layer is exposed to a lower pressure.

7. Apparatus for coating a moving web with a liquid composition comprising a plurality of liquid layers wherein layers within said composition are separate and distinct comprising in combination a. means forming a cavity adjacent a path along which the web is to be moved;

b. means forming a plurality of spaced liquid flow paths having discharge slots exiting into said cavity to admit a plurality of liquids into said cavity and thereby form a pool comprising a plurality of separate and distinct continguous superposed liquid layers with reduced velocities and increased thicknesses relative to the velocities of the liquids in the slots and the thicknesses of the slots, said slots being formed in locations spaced progressively farther from said path of web movement and said liquid flow paths being aligned in directions that do not intersect the web so that each flow path is accessible by a cleaning probe inserted through the path slot with the moving web in place; and c. means for flowing the liquids in said pool directly across a gap between said pool and said moving web to form a bead thinning said layers and contacting and coating said web.

8. The apparatus of claim 7 in which said slots exit into said cavity along generally mutually convergent paths.

9. The apparatus of claim 7 in which said slots exit into said cavity along generally mutually parallel paths.

10. The apparatus of claim 7 including means for establishing a pressure differential across the liquid composition in said gap wherein the lowermost layer is exposed to a lower pressure.

11. The apparatus of claim 8 including means for establishing a pressure differential across the liquid composition in said gap wherein the lowermost layer is exposed to a lower pressure.

12. The apparatus of claim 9 including means for establishing a pressure differential across the liquid composition in said gap wherein the lowermost layer is exposed to a lower pressure.

* * * * *